United States Patent [19]

Tadokoro et al.

[11] Patent Number: 4,566,422

[45] Date of Patent: Jan. 28, 1986

[54] FUEL INTAKE SYSTEM FOR A SUPERCHARGED ENGINE

[75] Inventors: Tomoo Tadokoro; Haruo Okimoto; Ikuo Matsuda, all of Hiroshima, Japan

[73] Assignee: Mazda Motor Corporation, Hiroshima, Japan

[21] Appl. No.: 672,857

[22] Filed: Nov. 19, 1984

Related U.S. Application Data

[63] Continuation of Ser. No. 418,746, Sep. 16, 1982, abandoned.

[30] Foreign Application Priority Data

Sep. 22, 1981 [JP] Japan ..... 56-149939
Sep. 28, 1981 [JP] Japan ..... 56-154439

[51] Int. Cl.[4] ..... F02B 33/36
[52] U.S. Cl. ..... 123/559; 123/432
[58] Field of Search ..... 60/304, 305, 306, 307; 123/432, 559, 213

[56] References Cited

U.S. PATENT DOCUMENTS

| | | | |
|---|---|---|---|
| 1,562,692 | 11/1925 | Lucay | 123/432 |
| 1,651,250 | 11/1927 | Brownback | 123/559 |
| 1,892,124 | 12/1932 | Abell | 123/433 |
| 2,016,846 | 10/1935 | Waseige | 123/559 |
| 2,453,377 | 11/1948 | Lozivit | 123/432 X |
| 3,665,905 | 5/1972 | Brille et al. | 123/559 |
| 3,964,451 | 6/1976 | Goto | 123/432 |
| 4,062,333 | 12/1977 | Matsuda et al. | 123/564 |
| 4,285,310 | 8/1981 | Takizawa et al. | 123/432 X |
| 4,315,489 | 2/1982 | Tadokoro et al. | 123/213 |
| 4,350,135 | 9/1982 | Casey et al. | 123/564 |

FOREIGN PATENT DOCUMENTS

| | | | |
|---|---|---|---|
| 657993 | 3/1938 | Fed. Rep. of Germany | 123/564 |
| 2746022 | 4/1979 | Fed. Rep. of Germany | 123/432 |
| 439689 | 4/1912 | France | 123/432 |
| 069722 | 5/1980 | Japan . | |
| 156226 | 12/1980 | Japan | 123/432 |
| 000519 | 1/1981 | Japan | 123/432 |
| 85522 | 7/1981 | Japan | 123/432 |

OTHER PUBLICATIONS

"Supercharging for Fuel Economy", Buike et al., *Automotive Engineering,* vol. 89, No. 6, Jun. 1981, pp. 39–43.

*Primary Examiner*—Michael Koczo
*Attorney, Agent, or Firm*—Burns, Doane, Swecker and Mathis

[57] ABSTRACT

For a supercharged internal combustion engine having at least one engine cylinder, a fuel intake system comprises a primary intake passage for supplying a combustible air-fuel mixture to the engine cylinder, and an auxiliary intake passage including a supercharger for supplying at least supercharged air to the engine cylinder, said supercharger being constituted by a displacement air pump and adapted to be driven by the engine such as to produce and supply the supercharged air into the engine cylinder at least during the period in which the engine cylinder is held under the compression stroke.

6 Claims, 4 Drawing Figures

FUEL INTAKE SYSTEM FOR A SUPERCHARGED ENGINE

This application is a continuation of application Ser. No. 418,746, filed Sept. 16, 1982, now abandoned.

BACKGROUND OF THE INVENTION

The present invention relates generally to a fuel intake system for an automobile internal combustion engine and, more particularly, to a supercharger used in the fuel intake system.

For boosting the power output of the automobile internal combustion engine, the use of a supercharger has long been well known. In particular, the supercharger of a type comprising a compressor and a turbine connected together with the compressor and adapted to be driven by exhaust gases emitted from the engine is generally referred to as a turbo supercharger or a turbo-charger.

With the supercharger utilizing the exhaust-gas turbine, i.e., the turbocharger, it has often been experienced, and it is quite natural that, even though the engine is operating under a condition requiring the supply of the supercharged air or air-fuel mixture, the latter tends to be short of the required amount particularly when the engine operates at a low speed with the flow of the exhaust gases consequently retarded.

In order to obviate the above described problem, a solution is disclosed in any one of the Japanese Laid-open Pat. Publications No. 55-137314 and No. 55-156226, laid open to public inspection on Oct. 27, 1980 and Dec. 5, 1980, respectively, and U.S. Pat. No. 4,315,488 and No. 4,315,489, both patented Feb. 16, 1982.

All of these publications discloses a fuel intake system which comprises a primary intake system and an auxiliary intake system including a supercharger in the form of a displacement air pump driven by a drive unit, for example, the automobile engine. These prior art fuel intake systems are generally so designed that, when and so long as the load imposed on the engine is smaller than a predetermined value, only the primary intake system is brought into operation to supply a combustible air-fuel mixture into the engine through an associated primary intake port, but when and so long as the load on the engine is larger than the predetermined value and at least during the period in which the engine undergoes the compression stroke, the auxiliary intake system is brought into operation together with the primary intake system to allow a supercharged air from the supercharger to be supplied into the engine through an associated auxiliary intake port in parallel with the supply of the air-fuel mixture. These prior art systems appear advantageous in that, since the supercharger is comprised of the displacement air pump driven by the engine, the supply of the supercharged air into the engine would not be caused to be short of the required amount even at a low speed engine operating condition during which the flow of the exhaust gases through the exhaust manifold tends to be retarded.

Any one of the above discussed publications discloses the use of a primary throttle valve disposed in a primary intake passage of the primary intake system for regulating the flow of air prior to being mixed with fuel or an air-fuel mixture, an auxiliary throttle or timing valve disposed in an auxiliary intake passage of the auxiliary intake system downstream of the supercharger or displacement air pump with respect to the direction of flow of the supercharged air towards the engine, and a relief passage having a relief valve for relieving the supercharged air in part or in whole to the atmosphere or back to the suction side of the supercharger.

However, the auxiliary throttle or timing valve employed in the last two of the above mentioned Japanese publications as well as both of the U.S. patents is so positioned and so designed as to allow the supercharged air to flow therethrough to the engine in correspondence with change in load on the engine, for example, during the high load engine operating condition. On the other hand, the auxiliary throttle or timing valve employed in the first mentioned Japanese publication is so positioned and so designed as to allow the supercharged air to flow therethrough to the engine each time the engine is brought into the compression stroke.

Specifically, the fuel intake system in any one of the first three publications is disclosed as applied to the piston engine whereas that in any one of the last two publications is disclosed as applied to the rotary piston engine or Wankel engine. In particular, the first mentioned Japanese publication is directed to the use of the fuel intake system in a multi-cylinder internal combustion engine comprising, for example, two engine cylinders.

In any event, the use of the displacement air pump involves the following problem. Any fluid displacement device including, for example, the displacement air pump now under discussion, is of a design wherein suction and delivery ports thereof open and close alternately, and the delivery characteristic thereof exhibits a substantially pulsating flow of fluid during the continued operation of such device. Because of the above described design characteristic of the fluid displacement device, the supply of the supercharged air to the engine fluctuates for a given engine speed in such a manner that the engine receives the supercharged air at a time, but does not receive it at a different time, unless the displacement air pump is synchronized in operation with the engine, i.e., unless care is taken to render the timing at which the air pump delivers the supercharged air to match with the timing at which the engine requires the supercharged air (at least during the period in which the engine undergoes the compression stroke). Once this happens, the purpose for which the supercharger is utilized cannot be fulfilled to the maximum available extent.

In addition, the last mentioned Japanese publication, that is, Laid-open Pat. Publication No. 55-156226 also discloses the use of a secondary air supply system for supplying to an engine exhaust system a secondary air necessary to substantially purify the exhaust gases emitted from the engine. This secondary air supply system includes a secondary air supply passage extending between the delivery side of the supercharger and the exhaust manifold and having a flow regulator for controlling the effective cross sectional area of the secondary air supply passage according to the load on the engine. The flow regulator is in the form of a three-way rotary valve having three ports communicated respectively to the delivery side of the supercharger, the exhaust manifold and the suction side of the supercharger, the passage between the flow regulator and the suction side of the supercharger being used to relieve a portion of the supercharged air back to the suction side of the supercharger. In this arrangement, since the flow regulator is required separately of the supercharger, the fuel intake system for the engine tends to be complicated in construction and expensive to manufacture.

Moreover, when it comes to a multi-cylinder internal combustion engine, as the number of the engine cylinders increases, the supercharger as well as the timing valve necessary to distribute the supercharged air selectively into the engine cylinders must be driven at the increased speed to enable the supply of the supercharged air to be synchronized with the firing sequence in these engine cylinders. For example, assuming that the supercharger is driven at a given speed for the two-cylinder engine, the four-cylinder or six-cylinder engine will require the supercharger to be driven at a speed twice or three times the given speed because a longer time is required to complete the firing of all of the engine cylinders than in the two-cylinder engine. Accordingly, driving the supercharger at the increased speed may result in the overheating of the supercharger to such an extent as to result in the reduction in service life of the supercharger. Although this problem may be obviated if plural superchargers are employed in operatively coupled relation to each other, this obviously renders the system expensive in cost and complicated in structure and, yet, not reliable in operation.

SUMMARY OF THE INVENTION

Accordingly, the present invention has been developed with a view to substantially eliminating the above described disadvantages and inconveniences inherent in the prior art fuel intake systems used in association with the supercharged internal combustion engine and has for its essential object to provide an improved fuel intake system which is effective to initiate the supply of the supercharged air into the engine cylinder in synchronism with the rotation of the engine and at least during the period in which the engine cylinder is held under the compression stroke.

Another important object of the present invention is to provide an improved fuel intake system of the type referred to above, which is reliable in operation and simple in construction.

A further object of the present invention is to provide an improved fuel intake system of the type referred to above, wherein the servicing life of the supercharger can advantageously be increased because any possible overheating thereof could be avoided.

These and other objects of the present invention can be accomplished by providing a fuel intake system for a supercharged internal combustion engine having at least one engine cylinder defined therein, which system comprises a primary intake passage means for supplying a combustible air-fuel mixture to the engine cylinder, and an auxiliary intake passage means including a supercharger for supplying at least a supercharged air to the engine cylinder, said supercharger being constituted by a displacement air pump and adapted to be driven by the engine such as to produce and supply the supercharged air into the engine cylinder at least during the period in which the engine cylinder is held under the compression stroke.

BRIEF DESCRIPTION OF THE DRAWINGS

These and other objects and features of the present invention will become apparent from the following detailed description taken in conjunction with preferred embodiments thereof with reference to the accompanying drawings, in which.

DETAILED DESCRIPTION OF THE EMBODIMENTS

Figure 1:
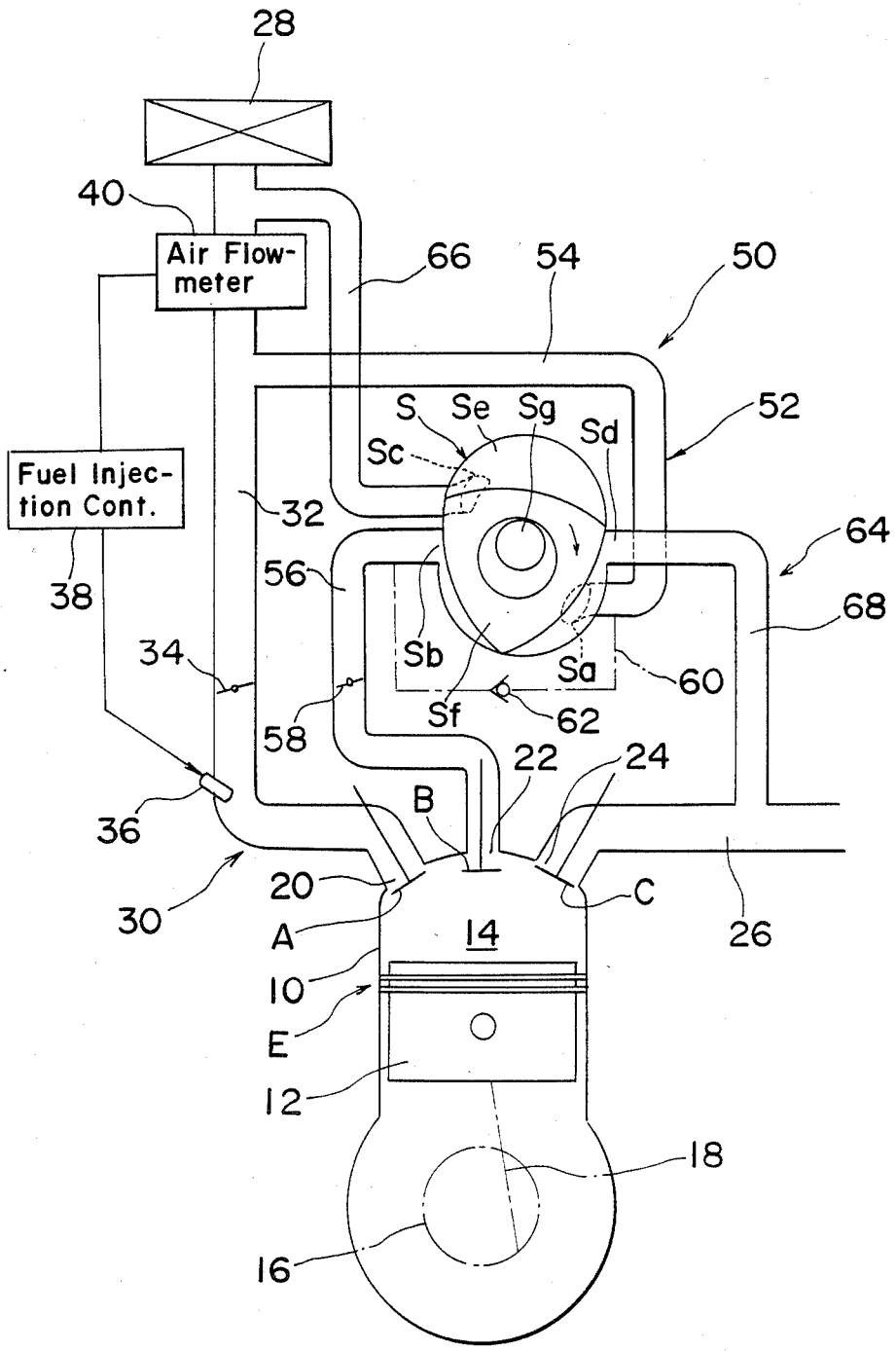
FIG. 1 is a schematic diagram showing a supercharged internal combustion engine together with its fuel intake system according to a preferred embodiment of the present invention.

Before the description of the present invention proceeds, it is indicated that the like parts are designated by like reference numerals throughout the accompanying drawings. In addition, it is to be noted that, although the internal combustion engine to which the present invention is applicable may be either a piston engine or a rotary piston engine, the present invention will be described in details as applied to the piston engine only for the purpose of illustration.

Referring first to FIG. 1, there is schematically shown an internal combustion engine E. The engine E so far illustrated is any known single cylinder internal combustion engine and comprises a cylinder casing 10, a piston 12 accommodated axially reciprocately movable within the cylinder casing 10 and defining a combustion chamber 14 of variable volume in cooperation with the cylinder casing 10, and a crank shaft 16 operatively coupled to the piston 12 through a connecting rod 18 and adapted to rotate as the piston 12 undergoes a linear motion.

The engine E has a primary intake port 20, an auxiliary intake port 22 and an exhaust port 24 which are defined in the cylinder casing 10 in communication with the combustion chamber 14 and which are adapted to be selectively opened and closed by a primary intake valve A, an auxiliary intake valve B and an exhaust valve C, respectively, in a predetermined timed sequence. While the exhaust port 24 is communicated to the atmosphere through an exhaust manifold 26 with or without any known exhaust gas purifier installed on the manifold 26, the primary and auxiliary intake ports 20 and 22 are communicated to the atmosphere through an air cleaner 28 by way of primary and auxiliary intake systems as will subsequently be described. It is, however, to be noted that the exhaust manifold 26 has the exhaust gas purifier (not shown) of any known construction, for example, at least one of the afterburner and catalytic converter, for the purpose as will become clear later.

The primary intake system, generally identified by 30, comprises a primary intake passage 32 having one end communicated to the atmosphere through the air cleaner 28 and the other end communicated to the primary intake port 20, a primary throttle valve 34 for regulating the flow of air to be supplied towards the combustion chamber 14 through the passage 32, and a fuel injection nozzle 36 for injecting fuel in a controlled manner into the passage 32 to form a combustible air-fuel mixture in admixture with the regulated flow of the air, said fuel injection nozzle 36 being positioned downstream of the throttle valve 34 with respect to the direction of flow of the air-fuel mixture towards the combustion chamber 14. So far illustrated, the amount of fuel to be injected into the passage 32 through the fuel injection nozzle 36 depends on the amount of air sucked by the engine and, for this purpose, the nozzle 36 is adapted to be controlled by a fuel injection control unit 38. As is well known to those skilled in the art, the fuel injection control unit 38 is adapted to receive an electrical signal indicative of the flow of air through the passage 32 at a position upstream of the throttle valve 34, which electrical signal is generated from an air flow-meter 40 of any known construction, for example, of a type comprising a measuring plate situated in the passage 32 and a potentiometer for converting the angular displacement of the measuring plate into the electrical signal for the indication of the rate of flow of the air drawn into the passage 32.

The primary throttle valve 34 is, as is well known, controlled by a foot-operated acceleration pedal and, for this purpose, is operatively coupled to the acceleration pedal (not shown) by means of a conventional linkage system (also not shown).

The auxiliary intake system, generally identified by 50, comprises a displacement supercharger S constituted by a rotary piston air pump of a construction as will be described later, and an auxiliary intake passage 52 extending between the primary intake passage 32 and the auxiliary intake port 22 through the rotary piston air pump S. The auxiliary intake passage 52 is constituted by a first passage section 54, communicated at one end to a portion of the primary intake passage 32 between the air flow-meter 40 and the primary throttle valve 34 and at the other end communicated to a first suction port Sa of the air pump S, and a second passage section 56 communicated at one end to a first exhaust port Sb of the air pump S and at the other end to the auxiliary intake port 22.

The auxiliary intake system 50 also comprises an auxiliary throttle valve 58 for regulating the flow of air delivered from the air pump S, and a relief passage 60 communicated at one end to the first passage section 54 and at the other end to a portion of the second passage section 56 downstream of the air pump S and upstream of the auxiliary throttle valve 58 with respect to the direction of flow of the supercharged air towards the combustion chamber 14, said relief passage 60 having a relief valve 62 for relieving the supercharged air in part or in whole back to the suction side of the air pump S, when the supercharged pressure becomes higher than a predetermined value, to maintain the supercharged pressure at such predetermined value.

The auxiliary throttle valve 58 is so operatively coupled to the primary throttle valve 34 by means of any suitable linkage that, only when and after the primary throttle valve 34 has been opened to a predetermined opening, i.e., moved a predetermined angle from a substantially closed position towards a full open position, the auxiliary throttle valve 58 can be opened, i.e., moved from a closed position towards a full open position. In other words, the auxiliary throttle valve 58 is so associated with the primary throttle valve 34 as to start opening when and after the load imposed on the engine has exceeded a predetermined value, that is, during a high load engine operating condition.

The engine E also includes a secondary air supply system 64 for supplying a pumped secondary air into the exhaust manifold 26 for the purpose of reburning an unburned component of the exhaust gases to minimize noxious compounds contained in the exhaust gases. This secondary air supply system 64 comprises an air suction passage 66 communicated at one end to the atmosphere through the air cleaner 28 and at the other end to a second suction port Sc of the air pump S and a supply passage 68 communicated at one end to a second exhaust port Sd of the air pump S and at the other end to the exhaust manifold 26.

The air pump S constituting the supercharger used in the present invention is of a construction based on the principles of the well known rotary piston internal combustion engine. This air pump SD comprises a housing structure including a pair of spaced end walls and a peripheral wall positioned between the end walls and assembled together to define a generally epitrochoidally cross-sectioned cavity Se within the housing structure, and a generally triangular rotary piston Sf eccentrically rotatably mounted on a driven shaft Sg within the cavity Se. The first and second exhaust ports Sb and Sd, communicated respectively to the auxiliary intake port 22 and the exhaust manifold 26, are defined in the peripheral wall at respective locations occupied by the associated lobes of the epitrochoidal cross-sectional shape of the cavity Se and in opposition to each other, whereas the first and second suction ports Sa and Sc are defined in, for example, one of the end walls at respective locations symmetrical to the driven shaft Sg and spaced a respective distance from the first and second exhaust ports Sb and Sd, respectively, in the direction of rotation of the rotary piston Sf as indicated by the arrow. The driven shaft Sg is so drivingly coupled to the crank shaft 16 in any suitable manner, or alternatively, to any suitable drive unit such as, for example, an electric motor powered by an automobile battery, that the rotary piston Sf can undergo a planetary motion within the cavity Se while apex portions of the rotary piston Sf sealingly slides along the epitrochoidally shaped inner surface of the peripheral wall, thereby performing a pumping function.

Figure 2:
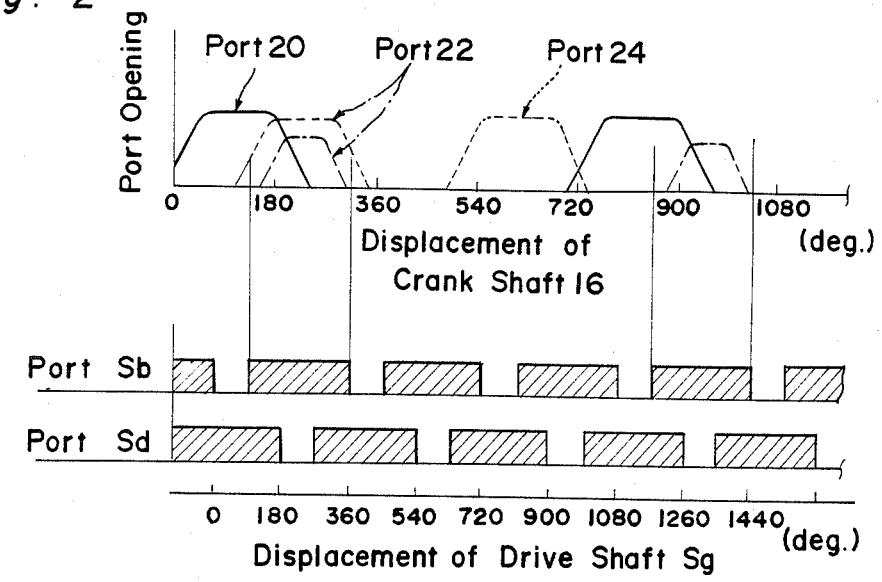
FIG. 2 is a timing chart showing the timed relationship between the opening of each port in the engine and the delivery of the supercharged air from a supercharger used in the system of FIG. 1.

The air pump S of the above described construction is so designed that air entering the cavity Se through the first suction port Sa is, after having been compressed during the continued rotation of the rotary piston Sf, discharged from the first exhaust port Sb into the second passage section 56 as the supercharged air while air entering the cavity Se through the second suction port Sc is similarly discharged as a compressed secondary air from the second exhaust port Sd into the secondary air supply passage 68. In the illustrated embodiment, since the ratio of the number of revolutions of the driven shaft Sg relative to the engine speed is selected to be 2:3, the timing at which the supercharged air emerges from the first exhaust port Sb is, as shown in FIG. 2, synchronized with and, preferably, matched with the opening of the auxiliary intake port 22 (i.e., the timing at which the auxiliary intake valve B opens the auxiliary intake port 22) and, accordingly, the supercharged air can be supplied into the combustion chamber 14 during the high load engine operating condition and, also, at least during the period in which the engine undergoes the compression stroke, that is, the combustion chamber 14 is held under the compression stroke. On the other hand, the timing at which the compressed secondary air emerges from the second exhaust port Sd relative to the timing at which the supercharged air emerges from the first exhaust port Sb is shown in FIG. 2 and is delayed a predetermined time dependent on the angular distance between the second exhaust port Sd and the first suction port Sa or between the first exhaust port Sb and the second suction port Sc.

As is well known to those skilled in the art, the valves A, B and C are operatively associated with the crank shaft 16 through a cam mechanism (not shown) to selectively open and close the associated ports 20, 22 and 24 in a predetermined timed sequence as shown in FIG. 2. Specifically, the primary and auxiliary intake valves A and B are, as shown by the curves depicted by the solid line and the single dashed chain line in FIG. 2, respectively, so timed that the auxiliary intake port B can be opened at the final stage of the opening of the primary intake port A, that is, when and after the engine E being operated enters the latter half of the suction stroke and can be held open until the next succeeding compression stroke terminates. It is, however, to be noted that, where any countermeasure is desired to be taken to avoid any possible back-flow of the air-fuel mixture from the combustion chamber 14 into the primary intake passage 32, the intake valves A and B may be so timed as to open the auxiliary intake port 22 immediately after the complete closure of the primary intake port 20 and during the period in which the engine E undergoes the compression stroke.

The fuel intake system of the construction so far described is so designed that, when and so long as the load imposed on the engine E is smaller than the predetermined value, only the primary intake system 30 is brought into operation to supply the air-fuel mixture into the combustion chamber 14 through the primary intake passage 32, but when and so long as the load on the engine E exceeds the predetermined value, both of the primary and auxiliary intake systems are brought into operation in such a way that, at least during the period in which the engine E undergoes the compression strike, the supercharged air from the rotary piston air pump S is supplied into the combustion chamber 14 through the auxiliary intake passage 52 simultaneously with the supply of the air-fuel mixture into the combustion chamber 14 through the primary intake passage 32. Therefore, it is clear that, during the low load engine operating condition in which no supercharged air is supplied to the combustion chamber 14 with the auxiliary throttle valve 56 held in the closed position, the engine E operates in a manner substantially similar to any conventional engine having no auxiliary intake system, but during the high load engine operating condition, the supercharged air is supplied into the combustion chamber 14 through the auxiliary intake system 50 in quick response in addition to the supply of the air-fuel mixture through the primary intake passage 32 and, therefore, the engine E can exhibit a favorable power output characteristic.

Particularly, during the low load engine operating condition in which the supply of the supercharged air is needed, since the timing at which the supercharged air emerges from the first exhaust port Sb is so timed with the timing at which the auxiliary intake port 22 is opened that the supply of the supercharged air into the combustion chamber 14 can be effected at least during the period in which the engine undergoes the compression stroke, any abrupt change in torque of the engine, which would result from the pulsating flow of the supercharged air, can advantageously be avoided, and accordingly, the drivability of the engine E can be improved.

Moreover, since the supercharger or air pump S is concurrently utilized as a pump for supplying into the exhaust manifold 26 the secondary air necessary to substantially purify the exhaust gases, the fuel intake system as a whole can advantageously be constructed simple in size and inexpensive in cost. However, the secondary air supply system 64 including the passages 66 and 68 and the ports Sc and Sd may not be always necessary.

In the foregoing embodiment, the present invention has been described as applied to the single cylinder internal combustion engine. However, the present invention can equally be applicable to a multi-cylinder internal combustion engine. This may be accomplished by connecting the first exhaust port Sb of the air pump S to the auxiliary intake ports of all of the engine cylinders by means of branch passages extending from the second passage section 56 downstream of the auxiliary throttle valve 58. However, according to this contemplated method, the driven shaft Sg and, hence, the rotary piston Sf must be driven at the increased speed in a manner similar to that discussed in connection with the prior art system, to enable the supply of the supercharged air selectively into the engine cylinders to be synchronized with the firing sequence in the engine cylinders.

According to the embodiment shown in FIG. 4, the rotary piston air pump S need not be driven at the increased speed, the details of which will now be described with particular reference to FIGS. 3 and 4.

Figure 4:
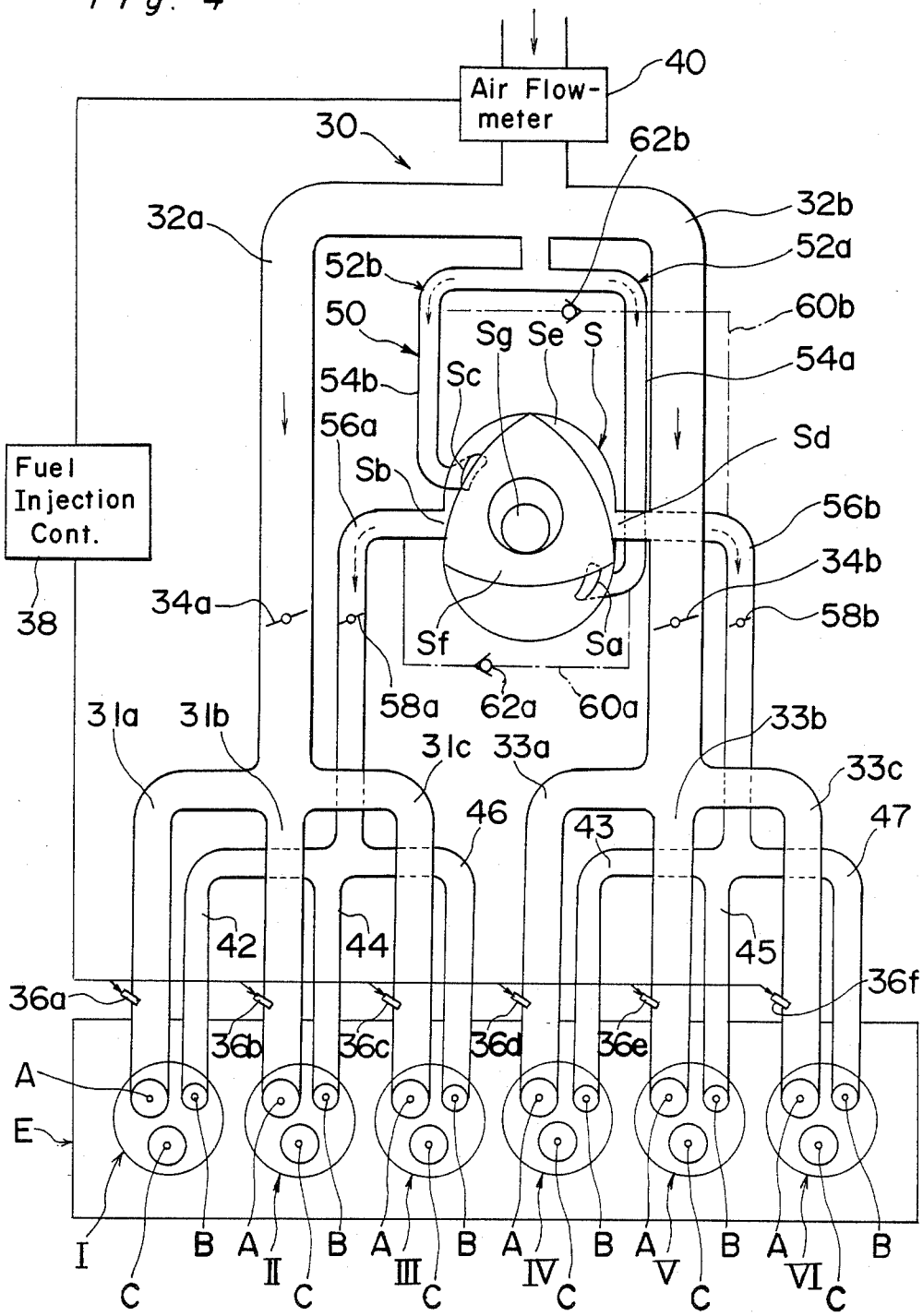
FIG. 4 is a schematic diagram similar to FIG. 1, but illustrating the system according to another preferred embodiment of the present invention.

Referring first to FIG. 4, the engine E is shown as having six cylinders or combustion chambers I, II, III, IV, V and VI and is so designed as to be fired in the sequence of the cylinder I, the cylinder IV, the cylinder II, the cylinder VI, the cylinder III and the cylinder V. These engine cylinders I to VI are grouped into a first cylinder group including the cylinders I to III and a second cylinder group including the cylinders IV to VI for the purpose of the present invention, it being to be noted that the cylinders I to III or IV to VI in any one of the first and second cylinder groups are those adapted to be fired at respective timings which are spaced the largest length of time in the firing sequence of all of the cylinders I to VI.

The primary intake system 30 shown in FIG. 4 comprises a first primary passage 32*a* communicated at one end to the air cleaner 28 (FIG. 1) through the air flow-meter 40 and at the other end to the respective primary intake ports 20 of the cylinders I, II and III of the first cylinder group through associated branch passages 31*a*, 31*b* and 31*c*, and a second primary passage 32*b* communicated at one end to the air cleaner 28 through the air flow-meter 40 and at the other end to the respective primary intake ports 20 of the cylinders IV, V and VI of the second cylinder group through associated branch passages 33*a*, 33*b* and 33*c*. The primary intake system 30 also comprises first and second primary throttle valves 34*a* and 34*b* disposed in the first and second primary intake passages 32*a* and 32*b*, respectively, and linked together to the foot-operated acceleration pedal, each of said throttle valves 34*a* and 34*b* functioning in a manner similar to the primary throttle valve 34 in the foregoing embodiment of FIG. 1. A plurality of fuel injection nozzles 36*a*, 36*b*, 36*c*, 36*d*, 36*e* and 36*f*, one for each engine cylinder, are disposed in the respective branch passages 31*a*, 31*b*, 31*c*, 33*a*, 33*b* and 33*c* and adapted to be controlled by the fuel injection control unit 38.

The auxiliary intake system 50 in this embodiment of FIG. 4 comprises first and second auxiliary intake passages 52*a* and 52*b*. The first auxiliary intake passage 52*a* is comprised of a first passage section 54*a* extending between the air flow-meter 40 and the first suction port Sa of the rotary piston air pump S and a second passage section 56*a* communicated at one end to the first exhaust port Sb of the air pump S and at the other end to the respective auxiliary intake ports 22 of the cylinders I, II and III of the first cylinder group through associated branch passages 42, 44 and 46. On the other hand, the second auxiliary passage 52*b* is comprised of a third passage section 54*b* extending between the air flow-meter 40 and the second suction port Sc of the air pump S and a fourth passage section 56*b* communicated at one end to the second exhaust port Sd of the air pump S and at the other end to the respective auxiliary intake ports 22 of the cylinders IV, V and VI of the second cylinder group through associated branch passages 43, 45 and 47. As is the case with the foregoing embodiment, each of the first and second auxiliary intake passages 52*a* and 52*b* includes a relief passage 60*a* or 60*b* having a respective relief valve 62*a* or 62*b* and bypassing the air pump S, and also a first or second auxiliary throttle valve 58*a* or 58*b* disposed in the second or fourth passage section 56*a* or 56*b* at a position downstream of the opening of the associated relief passage 60*a* or 60*b* into the respective second or fourth passage section 56*a* or 56*b*. The first and second auxiliary throttle valves 58*a* and 58*b* are operatively linked together and in turn so associated with one or both of the primary throttle valves 34*a* and 34*b* that, after the primary throttle valves 34*a* and 34*b* have been opened to the predetermined value in unison, the auxiliary throttle valves 58*a* and 58*b* can be opened in unison. In other words, the auxiliary throttle valves 58*a* and 58*b* are held closed when and so long as the load on the engine E is smaller than the predetermined value, that is, during the low load engine operating condition, but are opened when and so long as the load on the engine E has exceeded the predetermined value, that is, during the high load engine operating condition.

Figure 3:
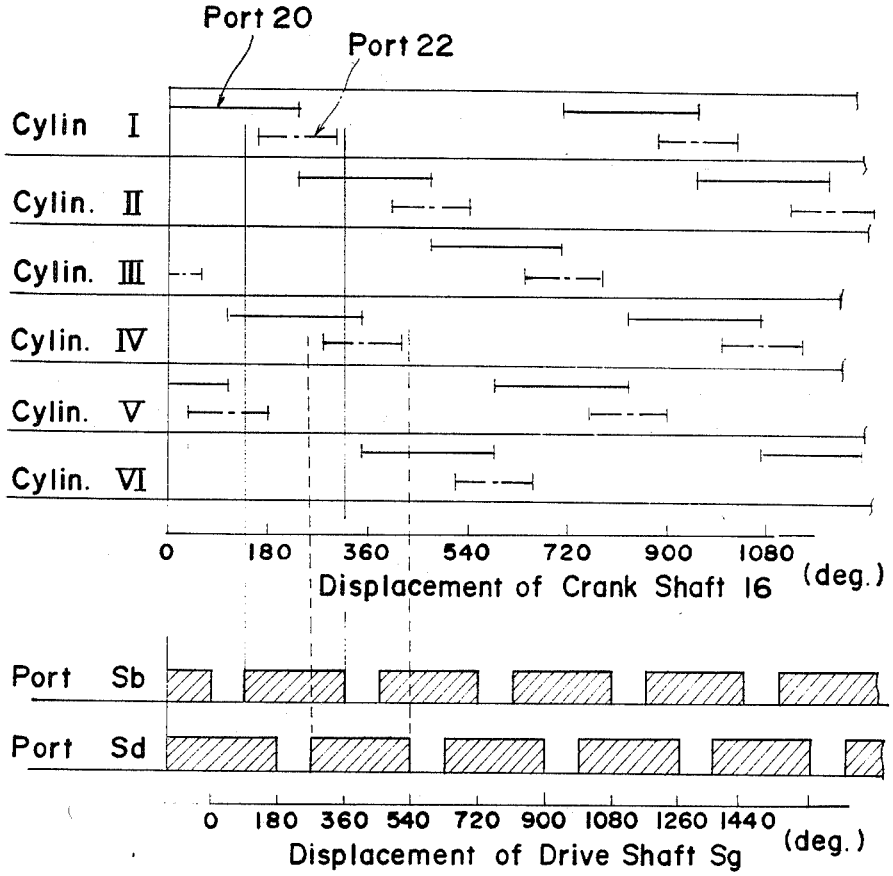
FIG. 3 is a chart similar to FIG. 2, but associated with the system shown in FIG. 4.

The primary and auxiliary intake valves A and B of all of the cylinders I to VI are so timed as to selectively open and close the associated primary and auxiliary intake ports 20 and 22 in these cylinders I to VI in a manner as shown in FIG. 3 wherein each solid line represents the duration of opening of the respective primary intake port 20 and each chain line represents the duration of opening of the respective auxiliary intake port 22. As can be readily understood from FIG. 3, and as is the case in the foregoing embodiment of FIG. 1, the auxiliary intake valve B in each of the cylinders I to VI opens the associated auxiliary intake port 22 in overlapping relation to the opening of the corresponding primary intake port 20 before the associated primary intake valve A closes the latter, and maintain the opening of the associated auxiliary intake port 22 generally until the compression stroke in the respective cylinder terminates. However, the primary and auxiliary intake valves A and B in each cylinder may be so timed as to render the auxiliary intake port 22 to open after the closure of the primary intake port 20 and during the period in which such cylinder is held under the compression stroke, by the reason which has been described in connection with the foregoing embodiment.

While the second suction and exhaust ports Sc and Sd of the air pump S in the foregoing embodiment shown in FIG. 1 have been described as used for the secondary air supply system, the embodiment shown in FIG. 4 is such that the second suction and exhaust ports Sc and Sd are utilized for the primary intake system for the purpose of supplying the supercharged air into the second cylinder group of the cylinders IV to VI in a manner alternately relative to the supply of the supercharged air into the first cylinder group of the cylinder I to III as shown in FIG. 3. Thus, when the driven shaft Sg of the air pump S is driven by the engine E at such a speed that the ratio of the number of revolution of the driven shaft Sg relative to the engine speed is 2:3, the timing at which the supercharged air emerges from the first exhaust port Sb and the timing at which the supercharged air emerges from the second exhaust port Sd can be synchronized and, preferably, matched with the opening of the auxiliary intake port 22 in each cylinder I to III of the first cylinder group and with that in each cylinder IV to VI of the second cylinder group, respectively, as shown in FIG. 3. Accordingly, it is at least during the period in which each cylinder is held under the compression stroke and during the high load engine operating condition that the supercharged air is supplied into the respective cylinder.

From the foregoing, it will readily be seen that, for a given engine cylinder, the fuel intake system according to the embodiment shown in FIG. 4 operates in a manner similar to that according to the embodiment shown in FIG. 1.

From the foregoing, it is clear that the air pump need not be driven at a speed increased with increase in number of the engine cylinders, but may be driven at a speed generally half the speed at which the air pump having single suction and exhaust ports would be driven. Therefore, the arrangement shown in FIG. 4 is advantageous in that the service life of the air pump can substantially be increased.

In addition, since the first and second auxiliary intake passages 52*a* and 52*b* are utilized one for each group of the cylinders I to VI, any possibility that the supercharged air may enter the adjacent two or more cylinders generally at the same time thereby rendering the amount of the supercharged air in one of these cylinders, which is held under the compression stroke, to be short of the required amount, can advantageously avoided.

Although the present invention has fully been described in connection with the preferred embodiments thereof with reference to the accompanying drawings, it is to be noted that various changes and modifications are apparent to those skilled in the art. By way of example, in the foregoing embodiment shown in any one of FIGS. 1 and 4, the timing at which the supercharged air emerges from the air pump has been so adjusted as to synchronize with the opening of the associated auxiliary intake port. However, it may be so adjusted that the supercharged air can enter the engine cylinder shortly after the opening of the auxiliary intake port and, in this case, it can be accomplished by increasing the amount of lift of the corresponding auxiliary intake valve substantially as shown by the double-dashed line in FIG. 2. This alternative method is advantageous in that, since no substantial resistance act on the flow of the supercharged air into the engine cylinder, the charge efficiency of the engine with the supercharged air can be improved and, on the other hand, the auxiliary throttle valve may be provided only for the purpose of avoiding any possible back-flow of the air-fuel mixture from the engine cylinder into the auxiliary intake passage.

Also, the concept of the present invention can be equally applicable where the fuel intake system includes any known carburetor system instead of the fuel injection system such as described and shown. In this case, the carburetor has to be positioned upstream of the junction between the primary and auxiliary intake passages to allow the fuel to be atomized in admixture with the air flowing past a venturi area. However, the present invention is particularly suited for use on the engine of fuel injection system in view of the fact that, where the carburetor is used, a portion of the air-fuel mixture flowing into the auxiliary intake passage tends to contaminate the air pump. In this connection, the fuel injection system including the air flow-meter, the fuel injection control unit and the injection nozzle, which has been described as employed for the primary intake system, may be utilized also for the auxiliary intake system.

In addition, the or each relief passage has been described as used for relieving the supercharged air in part or in whole to the suction side of the air pump in the event that the auxiliary throttle valve is closed or the pressure in the downstream side of the air pump exceeds the predetermined value. However, it may be used to relieve the supercharged air in part or in whole directly to the atmosphere. Moreover, whenever the or each relief passage is employed, any suitable clutch device may be employed between the driven shaft of the air pump and the crank shaft of the engine so that the driven shaft of the air pump can be drivingly coupled to the crankshaft of the engine only when the supply of the supercharged air into the engine cylinder or cylinders is required, that is, during the high load engine operating condition.

Accordingly such changes and modifications are to be understood as included within the true scope of the present invention unless they depart therefrom.

We claim:

1. A fuel intake system for a supercharged internal combustion engine having at least one engine cylinder defined therein, which system comprises, in combination:

primary intake passage means for supplying at least a suction air to the combustion chamber; and auxiliary intake passage means including a supercharger for supplying at least a supercharged air to the combustion chamber, said supercharger being constituted by a displacement air pump, said displacement air pump having a suction port, an exhaust port and a working chamber and being operable to exert a substantially pulsating flow of air from the exhaust port in correspondence with change in volume of the working chamber, means for driving said displacement air pump from the engine and for supplying the supercharged air into the combustion chamber at least during the period in which the combustion chamber is held under the compression stroke, said supercharger having first and second pairs of suction and exhaust ports, the suction and exhaust ports of the first pair being in communication with respective passage portions of the auxiliary intake passage means, and further comprising secondary air supply passage means for supplying a secondary air to an exhaust system of the engine, the suction and exhaust ports of the second pair being in communication with respective passage portions of the secondary air supply passage means.

2. A system as claimed in claim 1, wherein the displacement air pump is a rotary piston pump.

3. A fuel intake system for a supercharged internal combustion engine having at least one engine cylinder defined therein, which system comprises, in combination:

primary intake passage means for supplying at least a suction air to the combustion chamber; and auxiliary intake passage means including a supercharger for supplying at least a supercharged air to the combustion chamber, said supercharger being constituted by a displacement air pump, said displacement air pump having a suction port, an exhaust port and a working chamber and being operable to exert a substantially pulsating flow of air from the exhaust port in correspondence with change in volume of the working chamber, means for driving said displacement air pump from the engine and for supplying the supercharged air into the combustion chamber at least during the period in which the combustion chamber is held under the compression stroke, the engine having a plurality of combustion chambers, the auxiliary intake passage means including a plurality of independent auxiliary intake passages, and the supercharger having a plurality of pairs of suction and exhaust ports, the suction and exhaust ports of each pair being in communication with associated passage portions of the respective auxiliary intake passage.

4. A system as claimed in claim 3, wherein the displacement air pump is a rotary piston pump.

5. A fuel intake system for a supercharged internal combustion engine having a plurality of combustion chambers grouped into at least first and second groups, the combustion chambers in the first group being those adapted to be fired at respective timings which are spaced the largest length of time in the firing sequence of all of the engine cylinders in those groups and not fired sequentially, said system comprising, in combination:

first and second primary intake passage means for supplying at least a suction air to the first and second groups of the combustion chambers, respectively; and first and second auxiliary intake passage means including a supercharger for supplying at least a supercharged air to the first and second groups of the combustion chambers, respectively, said supercharger being constituted by a displacement air pump, said displacement air pump having at least one pair of working chambers and first and second pairs of suction and exhaust ports in correspondence with said working chambers and operable to exert a substantially pulsating flow of air from each of the exhaust ports, the suction and exhaust ports of the first pair being in communication with the first auxiliary passage means and the suction and exhaust ports of the second pair being in communication with the second auxiliary intake passage means, said supercharger being adapted to be driven by the engine such as to supply the supercharged air into each combustion chamber at least during the period in which such combustion chamber is held under the compression stroke.

6. A system as claimed in claim 5, wherein the displacement air pump is a rotary piston pump.

* * * * *